US009682546B2

(12) United States Patent
Takagi

(10) Patent No.: US 9,682,546 B2
(45) Date of Patent: Jun. 20, 2017

(54) LIQUID DISCHARGING SUBSTRATE, PRINTHEAD, AND PRINTING APPARATUS

(71) Applicant: CANON KABUSHIKI KAISHA, Tokyo (JP)

(72) Inventor: Makoto Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/934,332

(22) Filed: Nov. 6, 2015

(65) Prior Publication Data

US 2016/0144631 A1 May 26, 2016

(30) Foreign Application Priority Data

Nov. 21, 2014 (JP) ..... 2014-237018

(51) Int. Cl.

| | |
|---|---|
| ***B41J 29/393*** | (2006.01) |
| ***B41J 29/38*** | (2006.01) |
| ***B41J 2/045*** | (2006.01) |
| ***B41J 2/14*** | (2006.01) |

(52) U.S. Cl.

CPC ..... *B41J 2/0451* (2013.01); *B41J 2/0458* (2013.01); *B41J 2/04541* (2013.01); *B41J 2/14072* (2013.01); *B41J 2202/20* (2013.01)

(58) Field of Classification Search

CPC ..... B41J 29/393; B41J 2/2142; B41J 29/38; B41J 2/213; B41J 2/2132; B41J 2/0451; B41J 2/04541; B41J 2/0458; B41J 2/14072; B41J 2202/20

USPC ..... 347/14, 19, 50

See application file for complete search history.

(56) References Cited

U.S. PATENT DOCUMENTS

2014/0320566 A1* 10/2014 Jensen ..... B41J 2/14129 347/19

FOREIGN PATENT DOCUMENTS

JP 2004-58633 A 2/2004

* cited by examiner

*Primary Examiner* — Jannelle M Lebron

(74) *Attorney, Agent, or Firm* — Fitzpatrick, Cella, Harper & Scinto

(57) ABSTRACT

A liquid discharging substrate on which a plurality of discharging elements are arrayed, comprising a driving portion configured to drive the plurality of discharging elements, a detecting portion including a metal pattern arranged via an insulating member on a corner region of the substrate, and configured to detect damage to the corner region when the metal pattern breaks, and a controlling portion configured to stop the driving portion when the detecting portion detects that the corner region has been damaged.

21 Claims, 12 Drawing Sheets

LIQUID DISCHARGING SUBSTRATE, PRINTHEAD, AND PRINTING APPARATUS

BACKGROUND OF THE INVENTION

Field of the Invention

The present invention relates to a liquid discharging substrate, a printhead, and a printing apparatus.

Description of the Related Art

A printing apparatus includes, for example, a printhead in which a plurality of nozzles for discharging ink are provided. The printhead includes a printhead substrate (a liquid discharging substrate) on which a plurality of printing elements (discharging elements) corresponding to the plurality of nozzles are arrayed. A corner region of the printhead substrate is readily damaged due to a handling error at the time of manufacture or the like. When the printhead substrate is in use, corrosion advances from a corner region due to an ink mist sprayed from nozzles, and the corner region is readily damaged.

Japanese Patent Laid-Open No. 2004-58633 discloses a printhead substrate including a plurality of printing elements and two electrodes arranged to surround the plurality of printing elements. The two electrodes function as a detecting portion for detecting ink leakage in the printhead substrate. When the two electrodes contact ink, a current flows between the two electrodes, thereby detecting the occurrence of ink leakage in the printhead substrate. However, if the two electrodes are damaged due to a handling error at the time of manufacture or the like, it may be impossible to detect ink leakage in the printhead substrate.

SUMMARY OF THE INVENTION

The present invention provides a technique advantageous in detecting damage in a corner region of a printhead substrate and the like.

One of the aspects of the present invention provides a liquid discharging substrate, comprising a plurality of discharging elements arrayed on the substrate, a driving portion configured to drive the plurality of discharging elements, a detecting portion including a metal pattern arranged via an insulating member on a corner region of the substrate, and configured to detect damage to the corner region when the metal pattern breaks, and a controlling portion configured to stop the driving portion when the detecting portion detects that the corner region has been damaged.

Further features of the present invention will become apparent from the following description of exemplary embodiments with reference to the attached drawings.

DESCRIPTION OF THE EMBODIMENTS (Example of Arrangement of Printing Apparatus)

Figure 1A:
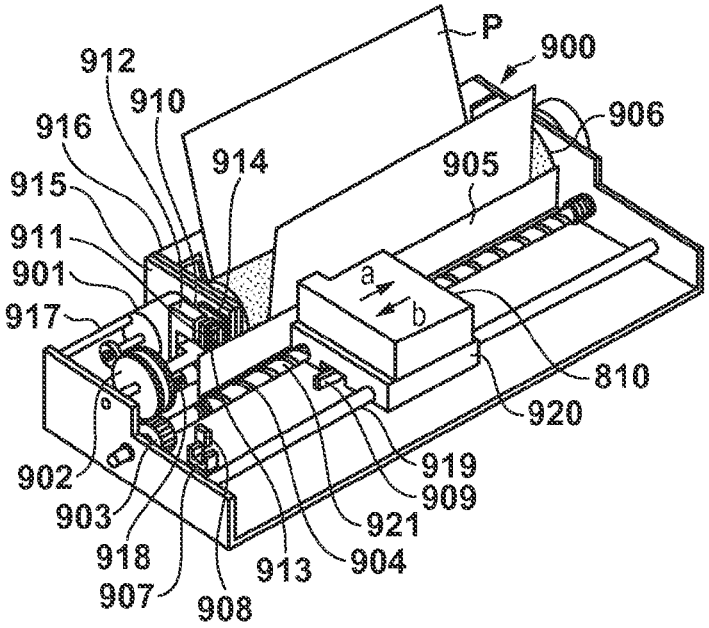
FIGS. 1A to 1D are views for explaining an example of the arrangement of a printing apparatus.

FIG. 1A exemplifies the internal arrangement of an inkjet printing apparatus 900 typified by a printer, a facsimile, a copy machine, or the like. The printing apparatus 900 includes a printhead 810 that discharges ink (printing material) to a printing medium P such as printing paper. The printhead 810 is mounted on a carriage 920, and the carriage 920 can be attached to a lead screw 921 having a helical groove 904. The lead screw 921 can rotate in synchronism with rotation of a driving motor 901 via driving force transfer gears 902 and 903. Along with this, the printhead 810 can move in a direction indicated by an arrow a or b along a guide 919 together with the carriage 920.

The printing medium P is pressed by a paper press plate 905 in the carriage moving direction and is fixed to a platen 906. The printing apparatus 900 reciprocates the printhead 810 and prints on the printing medium P conveyed on the platen 906 by a conveying portion (not shown).

The printing apparatus 900 confirms the position of a lever 909 provided on the carriage 920 via photocouplers 907 and 908, and switches the rotational direction of the driving motor 901. A support member 910 supports a cap member 911 for covering the ink orifices (nozzles) of the printhead 810. A suction means 912 performs recovery processing of the printhead 810 by sucking the interior of the cap member 911 via an intra-cap opening 913. A lever 917 is provided to start recovery processing by suction, and moves along with movement of a cam 918 engaged with the carriage 920. A driving force from the driving motor 901 is controlled by a well-known transfer means such as clutch switching.

A main body support plate 916 supports a moving member 915 and a cleaning blade 914. The moving member 915 moves the cleaning blade 914, and performs recovery processing of the printhead 810 by wiping. A print controlling portion (not shown) is also provided in the printing apparatus 900, and controls driving of each mechanism described above.

Figure 1B:
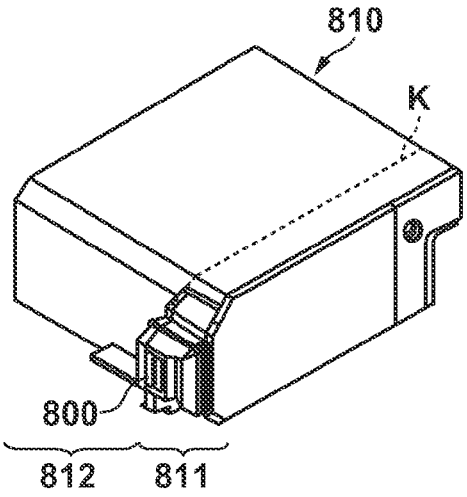

FIG. 1B exemplifies the outer appearance of the printhead 810. The printhead 810 can include a printhead portion 811 including a plurality of nozzles 800, and an ink tank 812 that holds ink to be supplied to the printhead portion 811. The ink tank 812 and the printhead portion 811 can be isolated at, for example, a broken line K, and the ink tank 812 can be changed. The printhead 810 includes an electrical contact (not shown) for receiving an electrical signal from the carriage 920, and discharges ink in accordance with the electrical signal to perform the above-described printing. The ink tank 812 includes, for example, a fibrous or porous ink holding member (not shown), and can hold ink by the ink holding member.

Figure 1C:
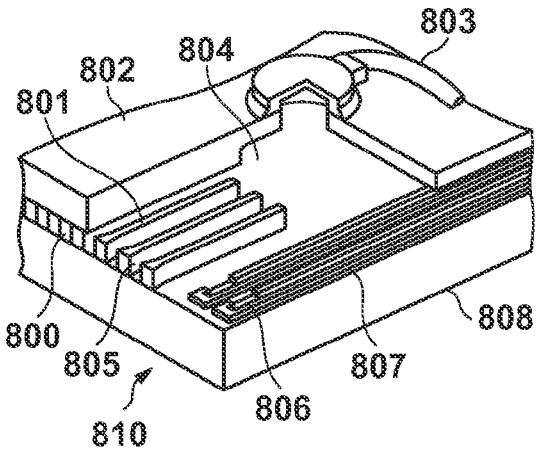

FIG. 1C exemplifies the internal arrangement of the printhead 810. The printhead 810 includes a substrate 808, channel wall members 801 that are arranged on the substrate 808 and form channels 805, and a top plate 802 having an ink supply path 803. As discharging elements, heaters 806 (electrothermal transducers) are arrayed on the printhead substrate of the printhead 810 in correspondence with the respective nozzles 800. When a driving element (switching element such as a transistor) provided in correspondence with each heater 806 is turned on, the heater 806 is driven to generate heat.

Ink from the ink supply path 803 is stored in a common ink chamber 804, and supplied to each nozzle 800 through the corresponding channel 805. The ink supplied to each nozzle 800 is discharged from the nozzle 800 in response to driving of the heater 806 corresponding to the nozzle 800.

Figure 1D:
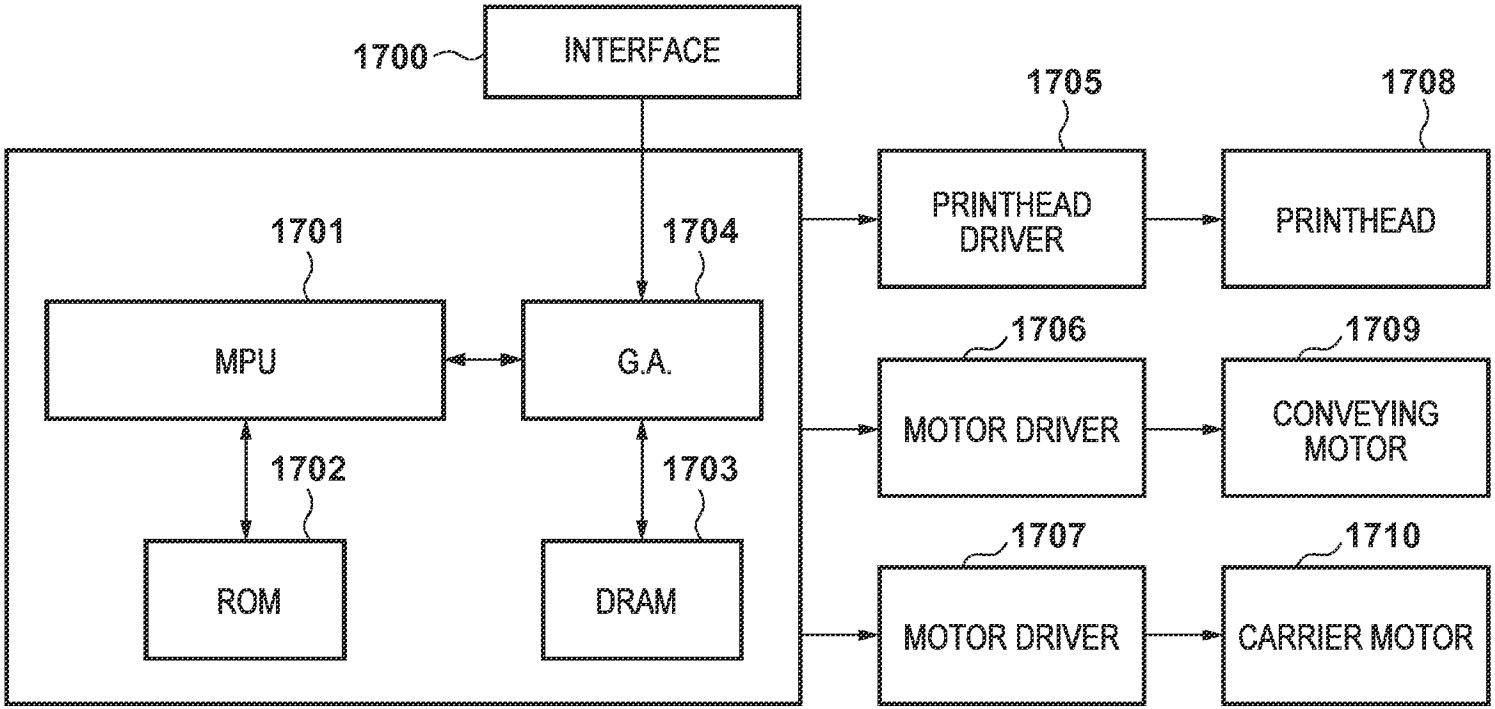

FIG. 1D exemplifies the system arrangement of the printing apparatus 900. The printing apparatus 900 includes an interface 1700, an MPU 1701, a ROM 1702, a RAM 1703, and a gate array 1704. The interface 1700 receives a printing signal. The ROM 1702 stores a control program to be executed by the MPU 1701. The RAM 1703 saves the above-mentioned printing signal, and various data such as printing data supplied to a printhead 1708. The gate array 1704 performs supply control of printing data to the printhead 1708, and controls data transfer between the interface 1700, the MPU 1701, and the RAM 1703.

The printing apparatus 900 further includes a printhead driver 1705, motor drivers 1706 and 1707, a conveying motor 1709, and a carrier motor 1710. The carrier motor 1710 conveys the printhead 1708. The conveying motor 1709 conveys the printing medium P. The printhead driver 1705 drives the printhead 1708. The motor drivers 1706 and 1707 drive the conveying motor 1709 and the carrier motor 1710, respectively.

When a printing signal is input to the interface 1700, it can be converted into printing data for printing between the gate array 1704 and the MPU 1701. Each mechanism performs a desired operation in accordance with the printing data, thus performing the above-described printing.

First Embodiment

A printhead substrate (a liquid discharging substrate) $I_1$ according to the first embodiment will be described below with reference to FIGS. 2 to 8.

Figure 2:
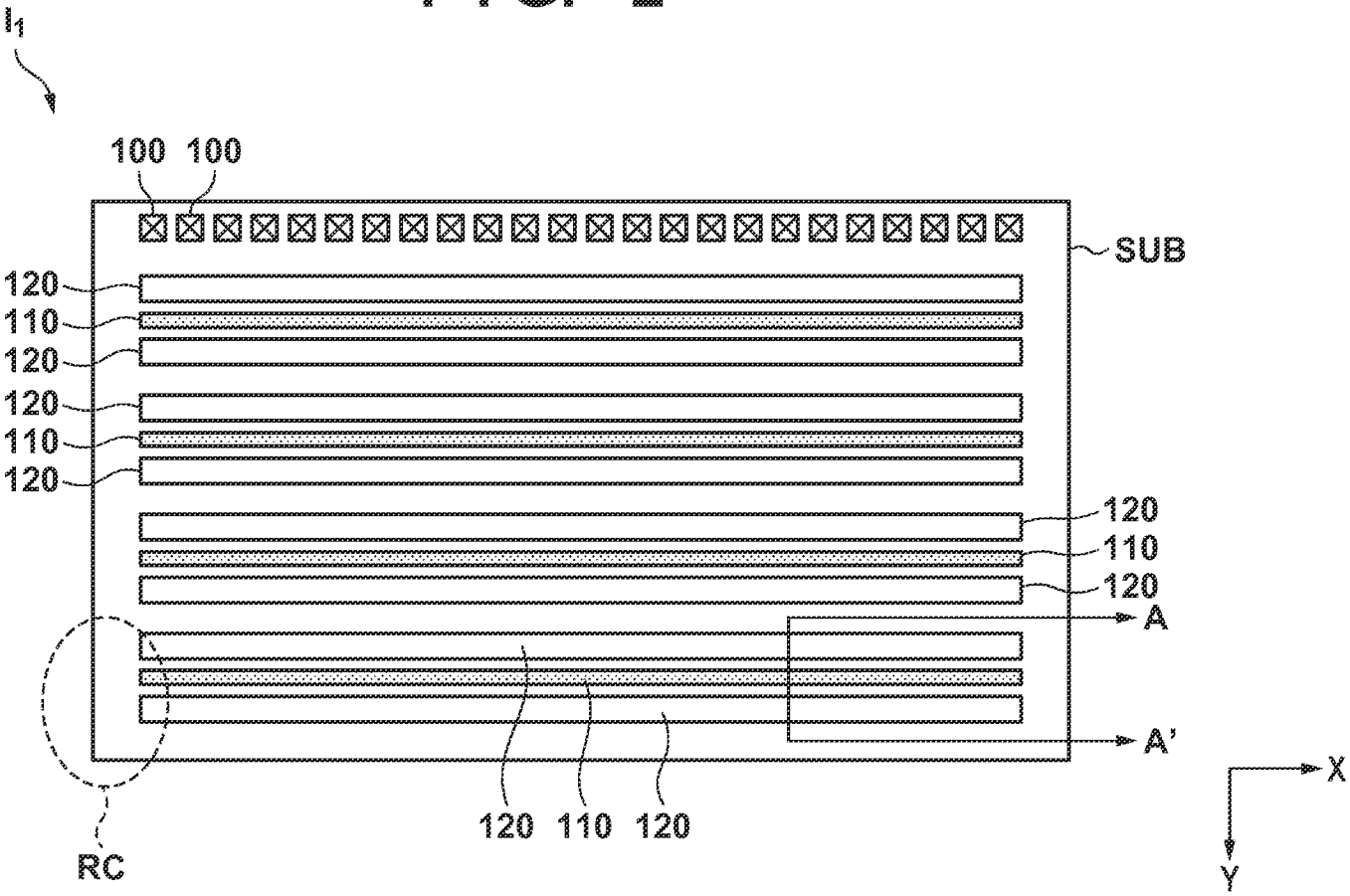
FIG. 2 is a view for explaining an example of the arrangement of a printhead substrate.

FIG. 2 is a schematic view showing the upper surface layout of the printhead substrate $I_1$ according to the first embodiment. The printhead substrate $I_1$ includes, for example, a plurality of pads 100 (electrode pads) arranged on a substrate SUB, ink supply paths 110 arranged on the substrate SUB, and printing portions 120 arranged on the substrate SUB and used to perform printing by discharging ink to a printing medium.

In this example, consider a case in which the substrate SUB (the outer shape thereof) has a rectangular shape having long sides parallel to the X direction and short sides parallel to the Y direction perpendicular to the X direction in a planer view with respect to the upper surface of the substrate SUB (to be simply referred to as a "planer view" hereinafter). The plurality of pads 100 are arranged side by side in the X direction near the long side of the substrate SUB. The plurality of pads 100 include pads for receiving a voltage to be supplied to circuit portions such as the printing portion 120 used for printing, and pads for receiving print data (or data corresponding to a print job).

Note that this example exemplifies an arrangement in which the plurality of pads 100 are arranged near one of the two long sides of the substrate SUB. However, the plurality of pads 100 may be arranged near both the two long sides. Alternatively, the plurality of pads 100 may be arranged near one or both of the two short sides.

Each ink supply path 110 is in fluid communication with the rear surface side of the substrate SUB, and is provided in, for example, a groove shape along the X direction. As will be described later, each printing portion 120 includes a plurality of discharging elements (heaters), and a plurality of driving elements and a plurality of logic portions in correspondence with the plurality of discharging elements. The plurality of discharging elements are arrayed along the corresponding ink supply path 110. Note that this example exemplifies an arrangement in which two printing portions 120 are arranged on both sides of one ink supply path 110. However, one printing portion 120 may be arranged on one side of one ink supply path 110.

Note that FIG. 2 exemplifies the four ink supply paths 110. In this arrangement, color printing may be supported by supplying inks of different colors to the ink supply paths 110 or the color gamut of one color may be extended by supplying inks of the same color to the ink supply paths 110.

Figure 3:
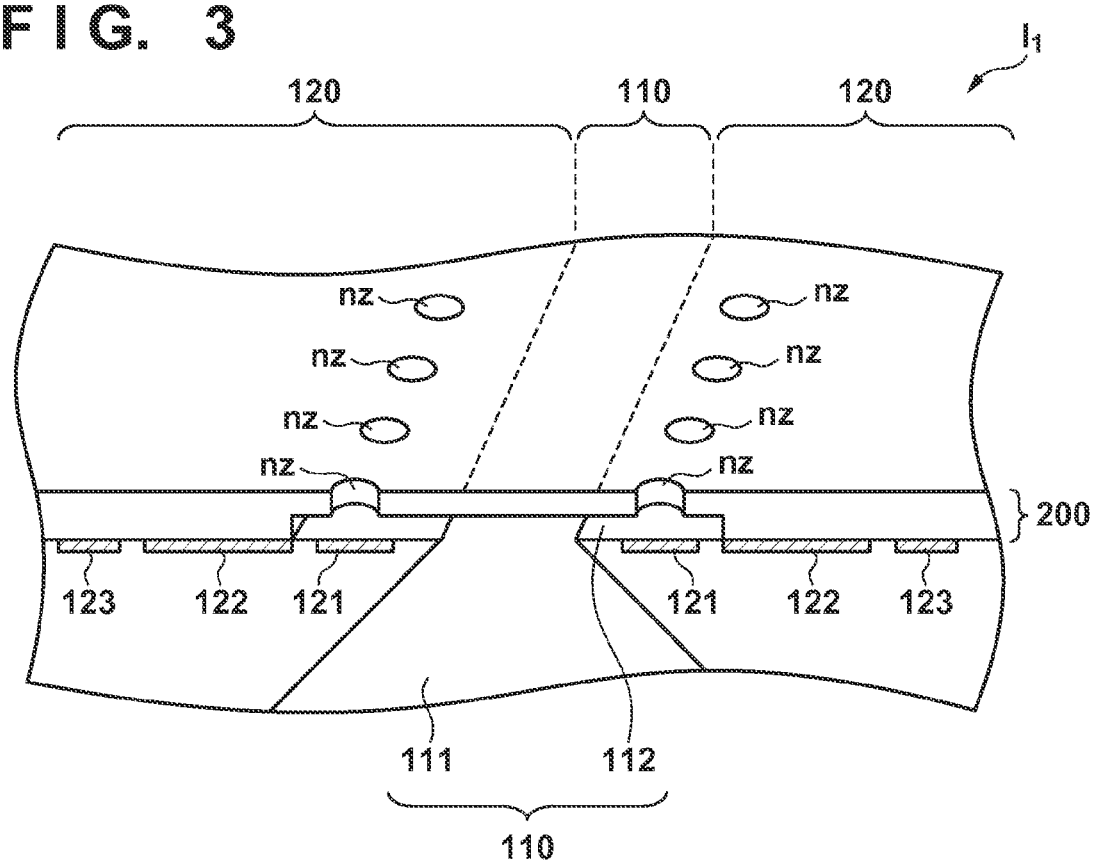
FIG. 3 is a view for explaining an example of the structure of the printhead substrate.

FIG. 3 shows a sectional structure taken along a cut ling A-A' shown in FIG. 2. Each printing portion 120 includes a discharging element 121, a driving element 122 for driving the discharging element 121, and a logic portion 123 for supplying a control signal to the driving element 122. These portions are formed on the substrate SUB from a side closer to the ink supply path 110 in the order of, for example, the discharging element 121, the driving element 122, and the logic portion 123. Each ink supply path 110 includes a first channel 111 for guiding ink from an ink tank, and a second channel 112 for guiding the ink from the channel 111 to the vicinity of each discharging element 121. A nozzle plate 200 in which nozzles nz corresponding to the respective discharging elements 121 are provided is arranged on the substrate SUB. When each discharging element 121 is driven, ink in the channel 112 is heated to cause bubbling, thereby discharging ink droplets from the corresponding nozzles nz.

Figure 4:
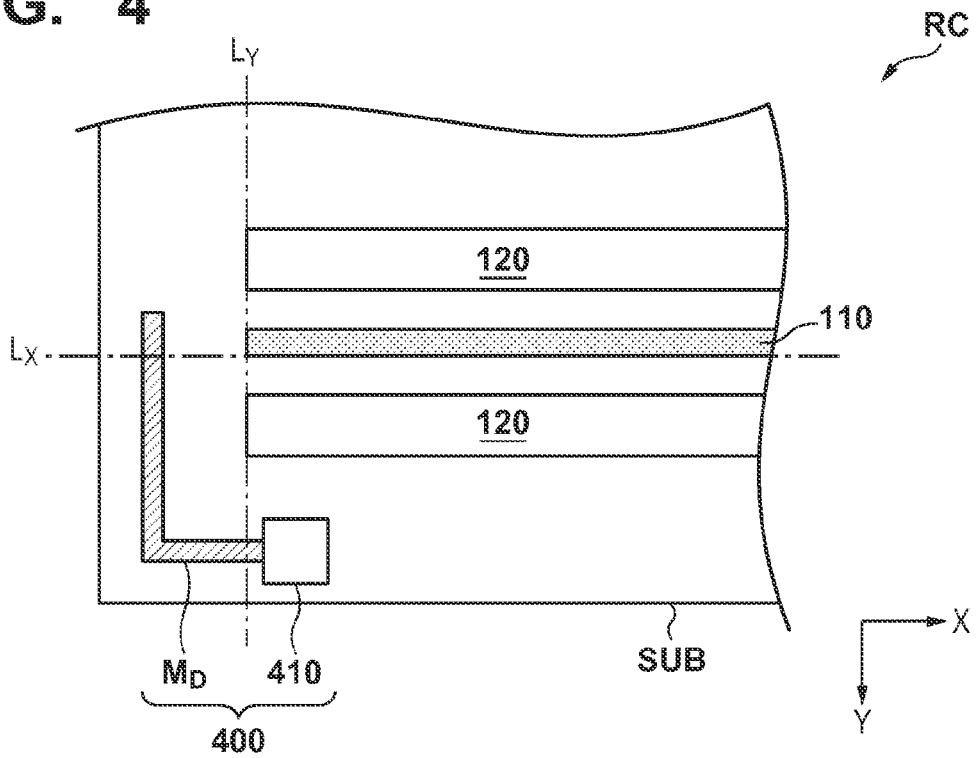
FIG. 4 is a view for explaining an example of the layout of a corner region of the printhead substrate.

FIG. 4 is an enlarged view of a corner region RC in the plan view of FIG. 2 showing the layout. The printhead substrate $I_1$ further includes a detecting portion 400 arranged in the corner region RC and used to detect damage to the corner region RC. The detecting portion 400 includes, for example, a metal pattern $M_D$ and a determination portion 410. The metal pattern $M_D$ is arranged on an insulating member on the substrate SUB, and the determination portion 410 determines whether the metal pattern $M_D$ breaks. In other words, the determination portion 410 functions as a monitor portion for monitoring the state of the metal pattern $M_D$. The metal pattern $M_D$ is preferably formed in an L shape along the edge of the substrate SUB. As will be described in detail later, damage to the corner region RC is detected with the above arrangement.

By paying attention to the ink supply path 110 closest to the corner of the substrate SUB corresponding to the corner region RC, it is assumed that a line $L_X$ represents a virtual line parallel to the X direction and passing through an end of the ink supply path 110 in the planar view. Assume also that a line $L_Y$ represents a virtual line parallel to the Y direction and passing through an end of the ink supply path 110 in the planar view. In this case, the metal pattern $M_D$ is preferably arranged over a region surrounded by at least the lines $L_X$ and $L_Y$ and two sides of the substrate SUB. Note that the two sides of the substrate SUB are two connected sides, and may be two sides substantially forming a corner or two sides connected by a corner portion having a curvature.

Typically, a corner region of the printhead substrate is readily damaged due to a handling error at the time of manufacture or the like. In an inkjet printhead substrate, a corner region is readily damaged by an ink mist sprayed from nozzles in use. Damage to the corner region by an ink mist can be caused when, for example, the nozzle plate 200 is separated by the mist to corrode the substrate SUB.

In this embodiment, the detecting portion 400 detects damage to the corner region RC, and when damage is detected, the operation of the printing portion 120 is stopped.

Figure 5:
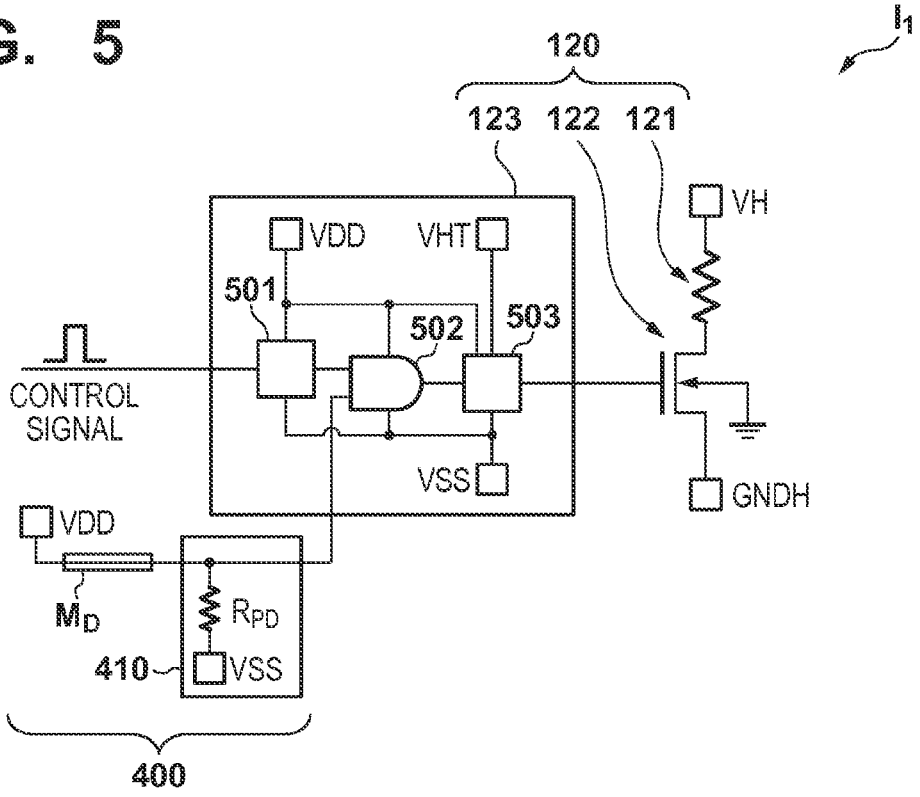
FIG. 5 is a circuit diagram for explaining examples of the circuit arrangements of a printing portion and detecting portion.

FIG. 5 shows examples of the circuit arrangements of the printing portion 120 and detecting portion 400. In the printing portion 120, the discharging element 121 and the driving element 122 are series-connected between a power supply node for transmitting a voltage VH (for example, 24 to 32 [V]) and a ground node for transmitting a ground voltage GNDH (0 [V]) corresponding to the voltage VH. For example, a heater (electrothermal transducer) is used as the discharging element 121 and a high-breakdown voltage transistor such as a DMOS transistor is used as the driving element 122.

In the printing portion 120, the logic portion 123 includes, for example, a signal processing circuit 501, an AND circuit 502, and a level shifter 503. A voltage VDD (for example, 3.3 [V]) and a ground voltage VSS (0 [V]) different from the voltage GNDH are supplied to the signal processing circuit 501, the AND circuit 502, and the level shifter 503. A voltage VHT (for example, 5 to 12 [V]) for shifting a level (for boosting a voltage) is also supplied to the level shifter 503.

The signal processing circuit 501 receives a control signal corresponding to print data to perform predetermined signal processing, and supplies a signal for controlling the driving element 122 to the AND circuit 502. Upon receiving the signal from the signal processing circuit 501 and a signal corresponding to the detection result of the detecting portion 400, the AND circuit 502 supplies the logical product of these signals to the level shifter 503.

The level shifter 503 shifts the level of the signal from the AND circuit 502 (boosts the voltage from the VDD level to the VHT level), and supplies the level-shifted signal to the control terminal (a gate terminal for a transistor) of the driving element 122. In response to this, the driving element 122 is turned on to drive the discharging element 121.

As described above, the detecting portion 400 includes, for example, the metal pattern $M_D$ and the determination portion 410. For example, the voltage VDD is supplied to the metal pattern $M_D$, and the metal pattern $M_D$ is connected to the voltage VSS via a resistance element $R_{PD}$ (so-called pull-down resistance) forming the determination portion 410. Therefore, if the corner region RC is not damaged, the output of the detecting portion 400 is at high level (H) almost equal to the voltage VDD. On the other hand, if the corner region RC is damaged and the metal pattern $M_D$ breaks, the output of the detecting portion 400 is set at low level (L) almost equal to the voltage VSS.

That is, if the detection result of the detecting portion 400 is at H, the output of the AND circuit 502 complies with the signal from the signal processing circuit 501. On the other hand, if the detection result is at L, the output of the AND circuit 502 is fixed at L (the AND circuit 502 does not output the signal from the signal processing circuit 501). In other words, the AND circuit 502 functions as a controlling portion that stops the driving element 122 not to drive the discharging element 121 when the corner region RC is damaged.

Note that FIG. 5 shows the one discharging element 121, and the driving element 122 and logic portion 123 in correspondence with the discharging element 121 with respect to the printing portion 120 for the sake of simplicity. However, the same applies to other discharging elements 121 and the like. That is, the detecting portion 400 supplies the detection result to each of a plurality of AND circuits 502.

Figure 6:
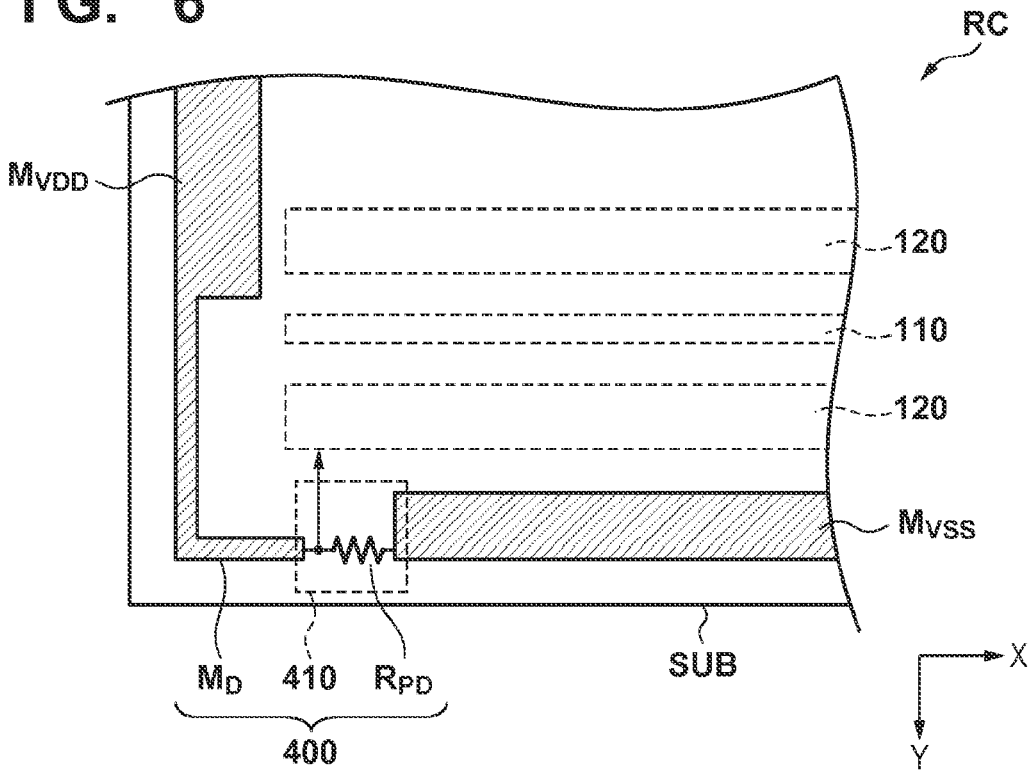
FIG. 6 is a view for explaining an example of the layout of the corner region of the printhead substrate.

FIG. 6 is a schematic view for mainly explaining a wiring layout in the corner region RC. The metal pattern $M_D$ is connected to a metal pattern $M_{VDD}$ for transmitting the voltage VDD and connected, via the resistance element $R_{PD}$, to a metal pattern $M_{VSS}$ for transmitting the voltage VSS. The metal patterns $M_D$, $M_{VDD}$, and $M_{VSS}$ may be arranged on the same wiring layer (metal layer) or different wiring layers.

The metal pattern $M_D$ is preferably arranged on, for example, the top layer (that is, a layer closest to the nozzle plate 200) out of a plurality of wiring layers arranged on the substrate SUB. This will be explained below with reference to FIG. 7.

Figure 7:
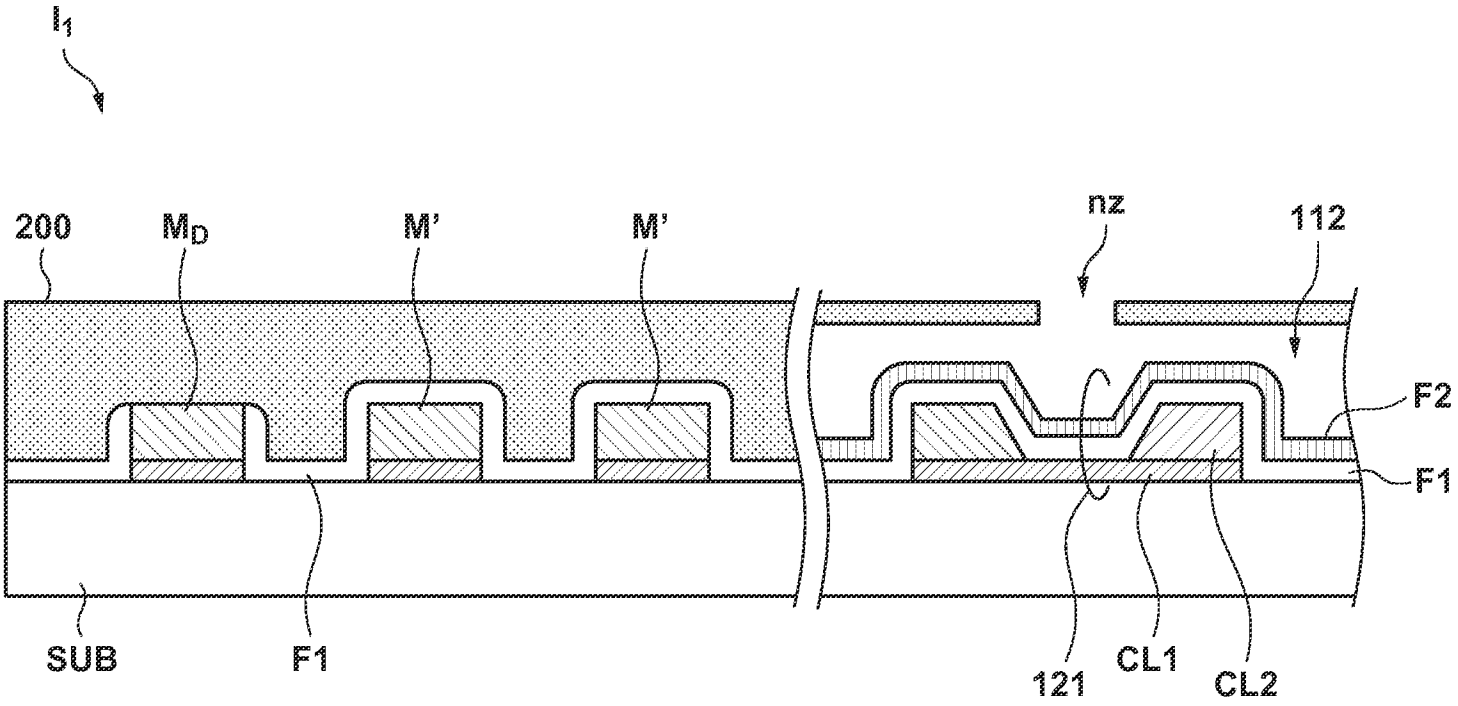
FIG. 7 is a view for explaining an example of the sectional structure of the printhead substrate.

FIG. 7 exemplifies the sectional structure of the printhead substrate $I_1$. The metal pattern $M_D$, metal patterns M', and the discharging elements 121 (metal members forming the discharging elements 121) are arranged on an insulating member (not shown) on the substrate SUB. Note that the metal pattern M' may be, for example, the metal pattern $M_{VDD}$ or $M_{VSS}$ exemplified in FIG. 6.

Each of the metal patterns $M_D$ and M' and the discharging elements 121 is arranged on the top layer out of the plurality of wiring layers, and can be constituted by, for example, a first conductive layer CL1 for forming a resistance element serving as a heater, and a second conductive layer CL2 for forming an electrode. The conductive layers CL1 and CL2 can be constituted by conductive members such as copper, aluminum, or the like that can break due to physical damage and can break due to dissolution or corrosion caused by an ink mist.

Out of the metal patterns $M_D$ and M' and the discharging elements 121, the metal patterns M' and the discharging elements 121 are covered with a protection film F1 (a silicon nitride film or the like) for preventing corrosion caused by an ink mist. The discharging elements 121 are also covered with an anti-cavitation film F2 (a tantalum film or the like) for protecting the discharging elements 121 from cavitation by the ink in the channel 112.

If the metal pattern $M_D$ is arranged on the top layer and at least part of the metal pattern $M_D$ is not covered with the protection film F1, the metal pattern $M_D$ erodes due to an ink mist and readily breaks. With this structure, damage to the corner region RC is readily detected.

Figure 8:
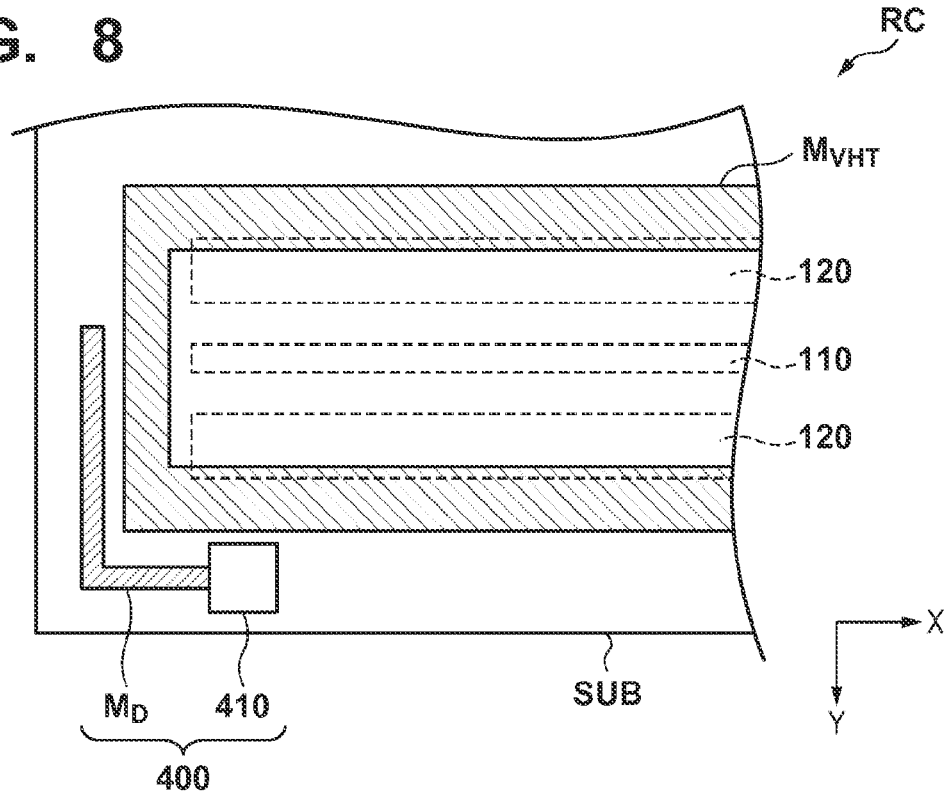
FIG. 8 is a view for explaining an example of the layout of the corner region of the printhead substrate.

FIG. 8 is a schematic view for mainly explaining, in the wiring layout in the corner region RC, the relationship between the metal pattern $M_D$ and another wiring layer different from the wiring layer on which the metal pattern $M_D$ is arranged. For example, a metal pattern $M_{VHT}$ for transmitting the voltage VHT is arranged on the other wiring layer, and the metal pattern $M_{VHT}$ can be arranged on the printing portion 120 in the planar view to supply the voltage VHT to the level shifter 503. In this case, the metal pattern $M_{VHT}$ is preferably arranged inside the metal pattern $M_D$ in the planar view. In other words, the metal pattern $M_D$ is preferably arranged outside other metal patterns in the planar view. Since an ink mist typically enters the substrate SUB from the edge side, the metal pattern $M_D$ corrodes before other metal patterns corrode in this structure and damage to the corner region RC is appropriately detected.

Note that the metal pattern $M_{VHT}$ arranged in the other wiring layer different from the wiring layer on which the metal pattern $M_D$ is arranged has been exemplified. However, a metal pattern arranged in the same wiring layer as that of the metal pattern $M_D$ may be arranged in the same manner. For example, the metal pattern $M_{VDD}$ or $M_{VSS}$ exemplified in FIG. 6 may be arranged inside the metal pattern $M_D$ on the substrate SUB in the planer view.

Note that the arrangement in which the metal pattern $M_D$ for receiving the voltage VDD or VHT is connected to the voltage VSS via the pull-down resistance (resistance element $R_{PD}$) has been exemplified. However, another arrangement may be adopted. For example, the metal pattern $M_D$ may receive the voltage VSS, and may be connected to the voltage VDD or VHT via a pull-up resistance. In this case, while the corner region RC is not damaged, the detection result of the detecting portion 400 is at L. When the corner region RC is damaged, the detection result changes to H. That is, the potential difference between the voltage of the metal pattern $M_D$ and a predetermined reference voltage changes in accordance with the presence/absence of damage to the corner region RC, and the detecting portion 400 is configured to detect the change.

Although the arrangement in which the one metal pattern $M_D$ is arranged has been exemplified, two or more metal patterns $M_D$ may be sequentially arranged from the edge side of the substrate SUB. With this arrangement, it is also possible to measure the degree of damage (damage level). Furthermore, although the arrangement in which the metal pattern $M_D$ is arranged in the corner region RC has been exemplified, the metal pattern $M_D$ need only be arranged in at least the corner region RC, and may be arranged along the edge of the substrate SUB.

As described above, according to this embodiment, it is possible to detect damage to the corner region RC of the printhead substrate $I_1$ with a relatively simple arrangement. This damage includes damage by a handling error at the time of manufacture or the like, and damage by corrosion caused by an ink mist, as described above. When the corner region RC is damaged, the printing portion 120 is controlled to stop the printing operation. Note that "the corner region RC is damaged" also includes a state in which the corner region RC has already been damaged. In this case, the printing portion 120 need only be controlled not to start a printing operation.

Second Embodiment

An arrangement for detecting damage to a corner region RC is not limited to the detecting portion 400 exemplified in the above-described first embodiment. Part of the detecting portion 400 may be changed according to the specifications of a printhead substrate and the like. For example, in the above-described first embodiment, a case in which a voltage VDD (for example, 3.3 [V]) is supplied to the metal pattern $M_D$ in the detecting portion 400 has been exemplified. However, another voltage may be supplied, and it is only necessary to supply a predetermined voltage from a predetermined voltage supplying portion. The second embodiment is mainly different from the first embodiment in that a voltage VHT (for example, 5 to 12 [V]) is supplied to a metal pattern $M_D$.

Figure 9:
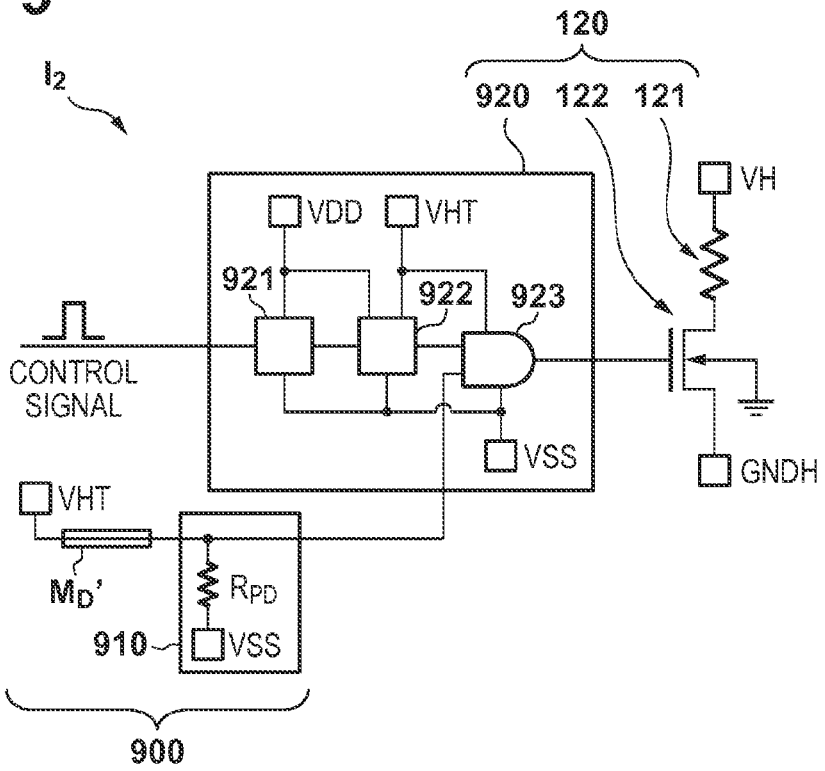
FIG. 9 is a circuit diagram for explaining examples of the circuit arrangements of a printing portion and detecting portion.

As exemplified in FIG. 9, a printhead substrate $I_2$ according to this embodiment includes a detecting portion 900 instead of the detecting portion 400, and includes a logic portion 920 instead of the logic portion 123.

The detecting portion 900 includes a metal pattern $M_D'$ supplied with the voltage VHT, and a determination portion 910 for connecting the metal pattern $M_D'$ to a voltage VSS via a resistance element $R_{PD}$ (so-called pull-down resistance). In this example, when the corner region RC is not damaged, the output of the detecting portion 900 is at H (a value almost equal to the voltage VHT). On the other hand, when the corner region RC is damaged, and the metal pattern $M_D'$ breaks, the output of the detecting portion 900 changes to L (a value almost equal to the voltage VSS).

The logic portion 920 includes a signal processing circuit 921, a level shifter 922 for shifting the level of a signal from the signal processing circuit 921, and an AND circuit 923 for outputting the logical product of a signal from the level shifter 922 and a signal corresponding to the detection result of the printing apparatus 900. That is, the logic portion 920 according to this embodiment is different from the logic portion 123 according to the first embodiment in terms of the connection order of the respective circuit portions constituting the logic portion.

According to this embodiment, the same effects as those in the first embodiment are obtained.

Third Embodiment

A printhead substrate $I_3$ according to the third embodiment will be described below with reference to FIGS. 10 to 12.

Figure 10:
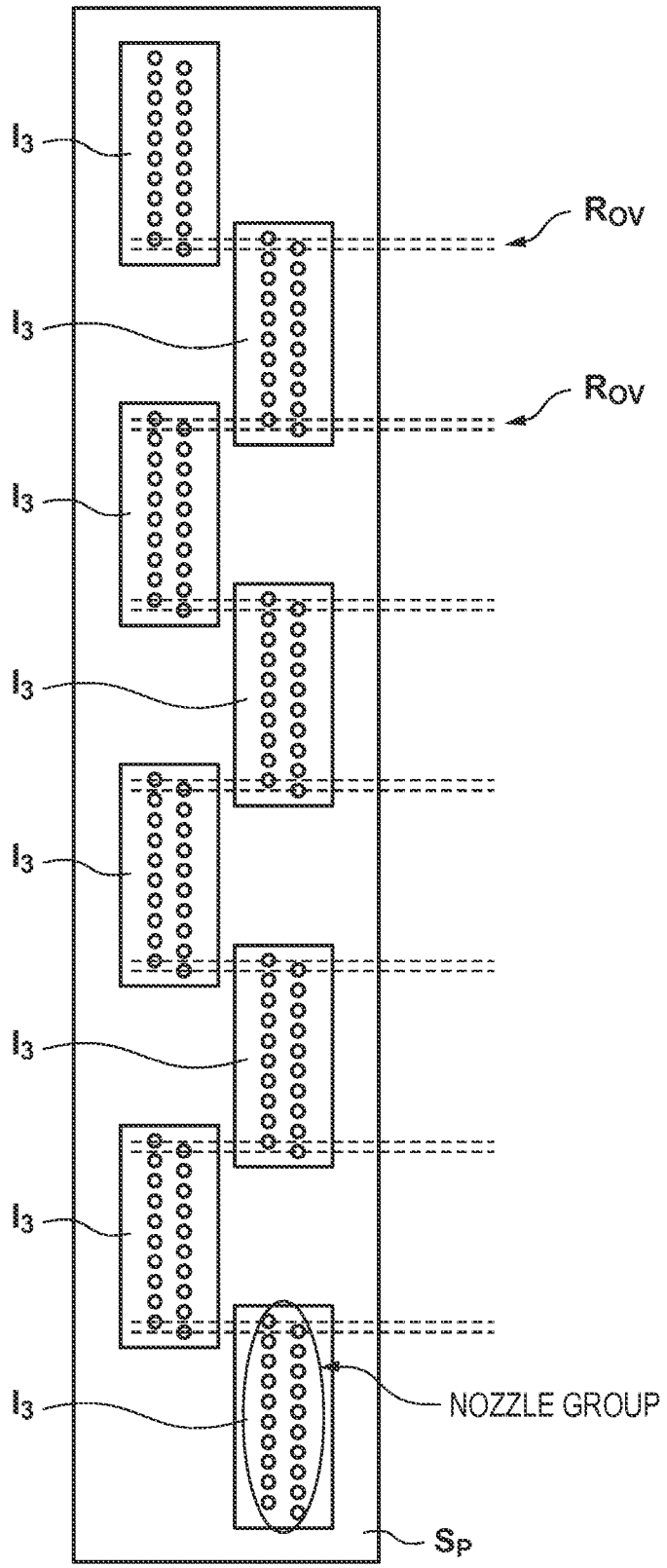
FIG. 10 is view for explaining an example of a printhead including a plurality of printhead substrates.

As exemplified in FIG. 10, a plurality of printhead substrates $I_3$ can be arranged on a surface $S_P$ on a side on which printing of a printhead is performed. The plurality of printhead substrates $I_3$ can be arrayed in a staggered pattern. With this arrangement, it is possible to increase a region in which printing can be performed on a printing medium by one scan of the printhead.

Each of the plurality of printhead substrates $I_3$ arrayed in a staggered pattern and its adjacent printhead substrate $I_3$ are preferably arrayed to overlap each other in their end portions in a direction intersecting the array direction. An overlapping region is indicated by a "region $R_{OV}$" in FIG. 10.

Note that the plurality of printhead substrates $I_3$ arrayed in a staggered pattern may be set as one group, and a plurality of groups may be arranged side by side in the direction intersecting the array direction. With this arrangement, it is also possible to improve the print speed by distributing print data to the respective groups.

In such arrangement, the plurality of printhead substrates $I_3$ may be configured to stop a printing operation when a corner region RC of at least one of the plurality of printhead substrates $I_3$ is damaged. This will be described below with reference to FIGS. 11 and 12.

Figure 11:
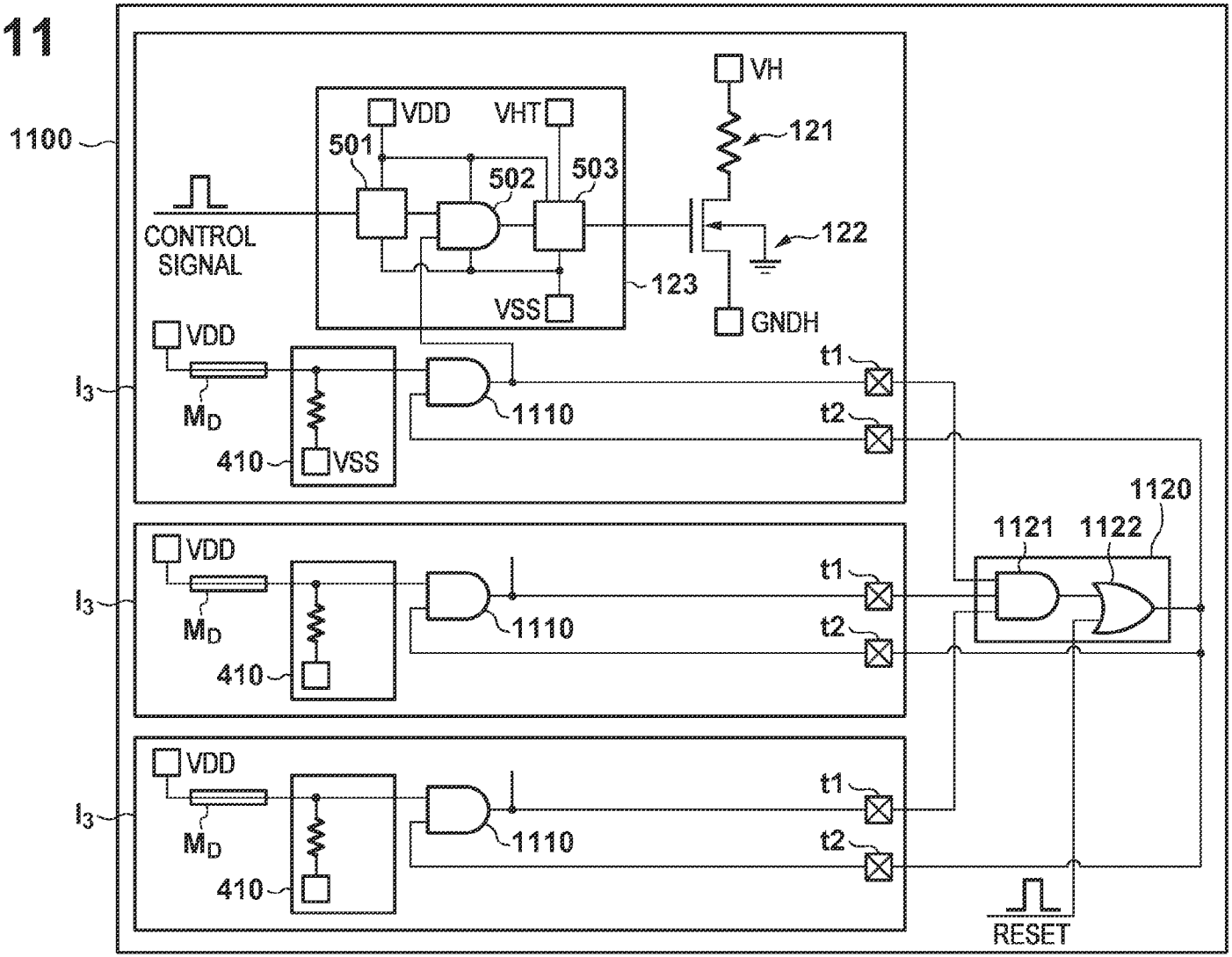
FIG. 11 is a circuit diagram for explaining an example of a method of controlling a printing portion in an arrangement including the plurality of printhead substrates.

FIG. 11 shows an example of the arrangement of a printhead 1100 as the first arrangement example. The printhead 1100 includes the plurality of printhead substrates $I_3$, and a substrate controlling portion 1120 provided in a region different from the printhead substrates $I_3$. Note that three substrates $I_3$ are shown in FIG. 11 for the sake of simplicity.

Each printhead substrate $I_3$ has the same arrangement as that of the printhead substrate $I_1$ according to the first embodiment except that an AND circuit 1110 is further included. The output terminal of the AND circuit 1110 is connected to a pad t1 and an input terminal of an AND circuit 502 of a logic portion 123. One input terminal of the AND circuit 1110 is connected to a pad t2. The other input terminal of the AND circuit 1110 is connected to a determination portion 410.

The substrate controlling portion 1120 includes, for example, an AND circuit 1121 and an OR circuit 1122. The plurality of input terminals of the AND circuit 1121 are respectively connected to the pads t1 of the plurality of printhead substrates $I_3$. The output terminal of the AND circuit 1121 is connected to one input terminal of the OR circuit 1122. A control signal RESET for reset is input to the other input terminal of the OR circuit 1122. The control signal RESET is set at H at the time of reset, and is set at L otherwise. The output terminal of the OR circuit 1122 is connected to the pads t2 of the plurality of printhead substrates $I_3$.

In the first arrangement example, when the corner region RC of at least one of the plurality of printhead substrates $I_3$ is damaged, the output of the corresponding AND circuit 1110 changes from H to L. In response to this, in the substrate controlling portion 1120, the output of the AND circuit 1121 changes from H to L and the output of the OR circuit 1122 changes from H to L. The output of the OR circuit 1122 is supplied to the AND circuit 1110 of each printhead substrate $I_3$ via the pad t2, and thus the outputs of the AND circuits 1110 of the remaining printhead substrates $I_3$ also change from H to L. As a result, in each of all the printhead substrates $I_3$, the output of the AND circuit 1110 is set at L, and upon receiving the output, the logic portion 123 turns off a driving element 122 to stop driving of a discharging element 121.

In the first arrangement example, therefore, when some of the plurality of printhead substrates $I_3$ are damaged, information indicating it is transmitted to the remaining printhead substrates $I_3$. This can prevent the damage from further advancing by the printing operations of the remaining printhead substrates $I_3$.

Figure 12:
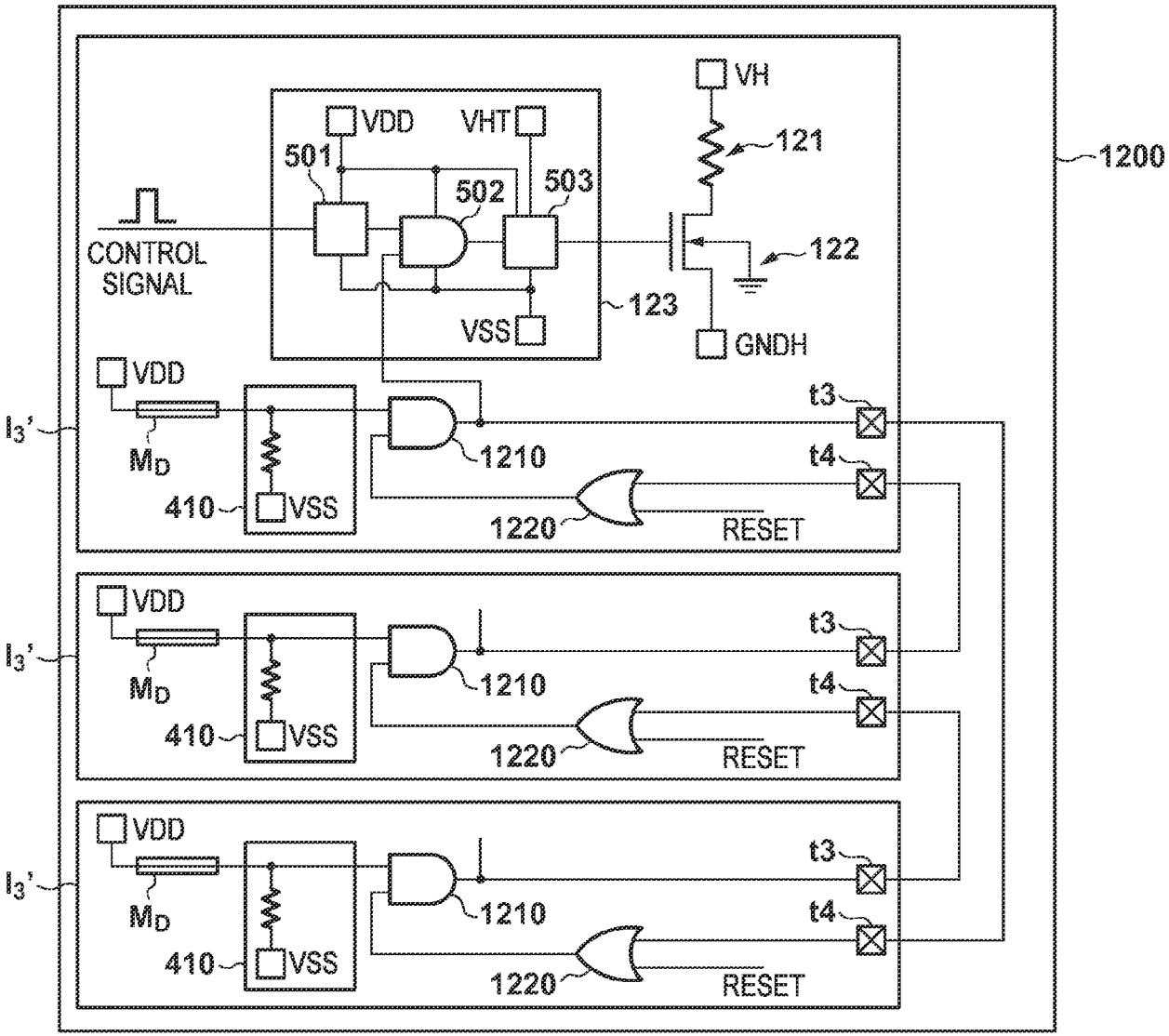
FIG. 12 is a circuit diagram for explaining an example of a method of controlling a printing portion in an arrangement including a plurality of printhead substrates.

FIG. 12 shows an example of the arrangement of a printhead 1200 as the second arrangement example. The printhead 1200 includes a plurality of printhead substrates $I_3'$. Each printhead substrate $I_3'$ has the same arrangement as that of the printhead substrate $I_1$ according to the first embodiment except that an AND circuit 1210 and an OR circuit 1220 are further included.

The output terminal of the AND circuit 1210 is connected to a pad t3 and an input terminal of an AND circuit 502 of a logic portion 123. One input terminal of the AND circuit 1210 is connected to a determination portion 410. The other input terminal of the AND circuit 1210 is connected to the output terminal of the OR circuit 1220. One input terminal of the OR circuit 1220 is connected to a pad t4. A control signal RESET for reset is input to the other input terminal of the OR circuit 1220.

The plurality of printhead substrates $I_3'$ are connected in a ring shape via the pads t3 and t4. More specifically, the pad t4 of the first printhead substrate $I_3'$ (the substrate $I_3'$ on the upper side of FIG. 12) and the pad t3 of the second printhead substrate $I_3'$ (the substrate $I_3'$ in the middle of FIG. 12) are connected to each other. The pad t4 of the second printhead substrate $I_3'$ and the pad t3 of the third printhead substrate $I_3'$ (the substrate $I_3'$ on the lower side of FIG. 12) are connected to each other. The pad t4 of the third printhead substrate $I_3'$ and the pad t3 of the first printhead substrate $I_3'$ are connected to each other.

In the second arrangement example, when a corner region RC of at least one of the plurality of printhead substrate $I_3'$ is damaged, the output of the corresponding AND circuit 1210 changes from H to L. In response to this, in the remaining printhead substrates $I_3'$ as well, the outputs of the OR circuits 1220 change from H to L, and the outputs of the AND circuits 1210 for respectively receiving the outputs of the OR circuits 1220 change from H to L. As a result, in each of all the printhead substrates $I_3$, the output of the AND circuit 1210 is set at L, and upon receiving the output, the logic portion 123 turns off a driving element 122 to stop driving of a discharging element 121. In addition, the second arrangement example is advantageous in reducing the manufacturing cost since it is not necessary to provide the substrate controlling portion 1120 exemplified in the first arrangement example (FIG. 11).

According to this embodiment, a plurality of printhead substrates are arranged in a printhead, and when a corner region of at least one of the printhead substrates is damaged, a printing operation is appropriately stopped. Therefore, according to this embodiment as well, the same effects as those in the first embodiment are obtained.

Note that the above-described first arrangement example has exemplified a case in which when the corner region RC of at least one of the plurality of printhead substrates $I_3$ is damaged, driving of the discharging elements 121 of all the printhead substrates $I_3$ is stopped. This embodiment, however, is not limited to this. For example, when the corner region RC of at least one printhead substrate $I_3$ is damaged, driving of the discharging elements 121 of the at least one printhead substrate $I_3$ and some of the remaining printhead substrates $I_3$ may be stopped. The same applies to the above-described second arrangement example.

Fourth Embodiment

In the above-described first embodiment, a case in which the substrate SUB (the outer shape thereof) of the printhead substrate $I_1$ has a rectangular shape has been exemplified. However, the present invention is not limited to this, and the substrate SUB may have another shape.

Figure 13A:
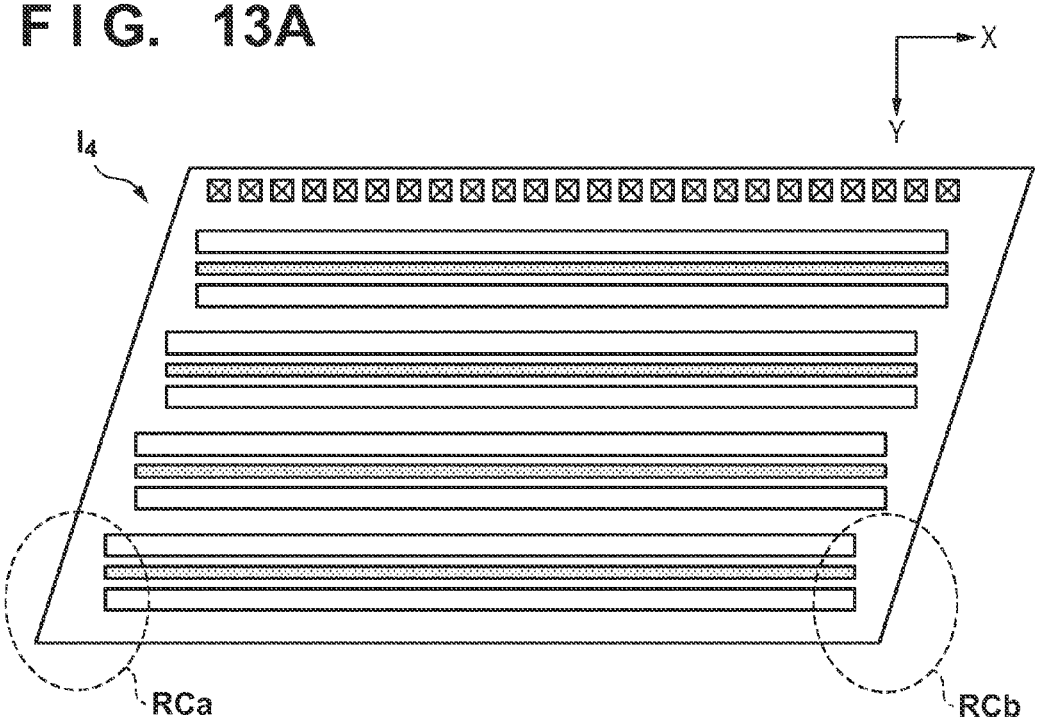
FIGS. 13A and 13B are views for respectively explaining an example of the arrangement of a printhead substrate and an example of the layout of a corner region.
Figure 13B:
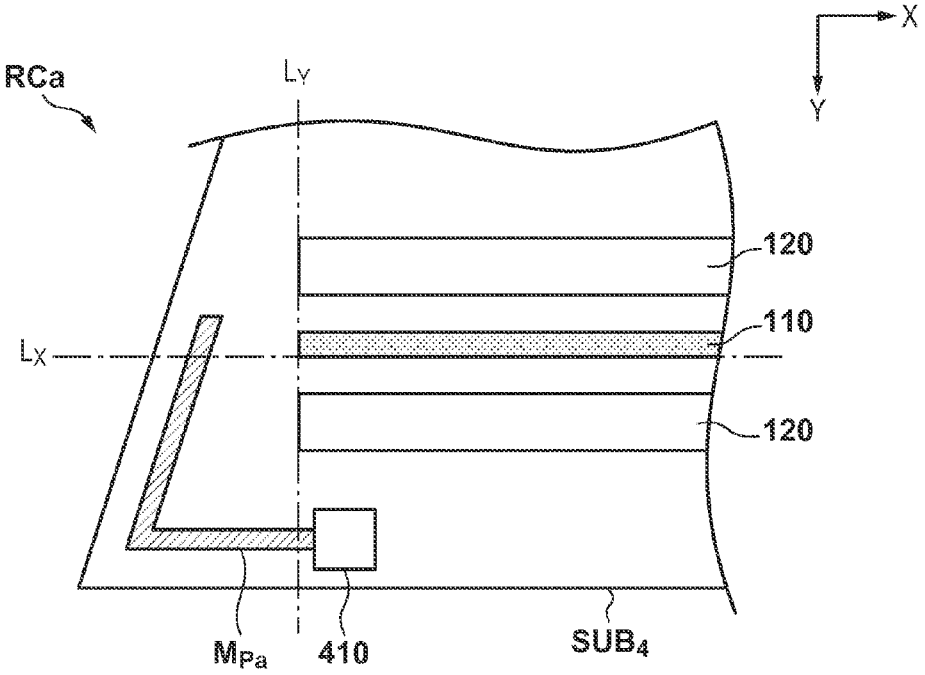

FIG. 13A shows the upper surface layout of a printhead substrate $I_4$ according to the fourth embodiment, and FIG. 13B shows a detecting portion 400*a* included in the printhead substrate $I_4$. This embodiment is mainly different from the above-described first embodiment in that a substrate $SUB_4$ of the printhead substrate $I_4$ has a shape of a parallelogram.

In this example, a corner region RCa having an acute interior angle is damaged more readily than a corner region RCb having an obtuse interior angle. Therefore, the detecting portion 400*a* is preferably arranged in each of at least two corner regions RCa out of the four corner regions RCa and RCb.

Each detecting portion 400*a* includes a metal pattern $M_{Da}$ and a determination portion 410. The metal pattern $M_{Da}$ is formed in an L shape along the edge of the substrate $SUB_4$. In this case, the metal pattern $M_{Da}$ is preferably arranged over a region surrounded by at least lines $L_X$ and $L_Y$ and two sides of the substrate $SUB_4$.

In this example, the structure in which the substrate $SUB_4$ has a shape of a parallelogram is advantageous in allowing appropriate detection of damage to the corner region RCa having an acute interior angle, which is damaged more readily than the corner region RCb having an obtuse interior angle. Note that the arrangement in which the detecting portion 400*a* is arranged in each corner region RCa has been exemplified but another detecting portion may be arranged in each corner region RCb.

Figure 14:
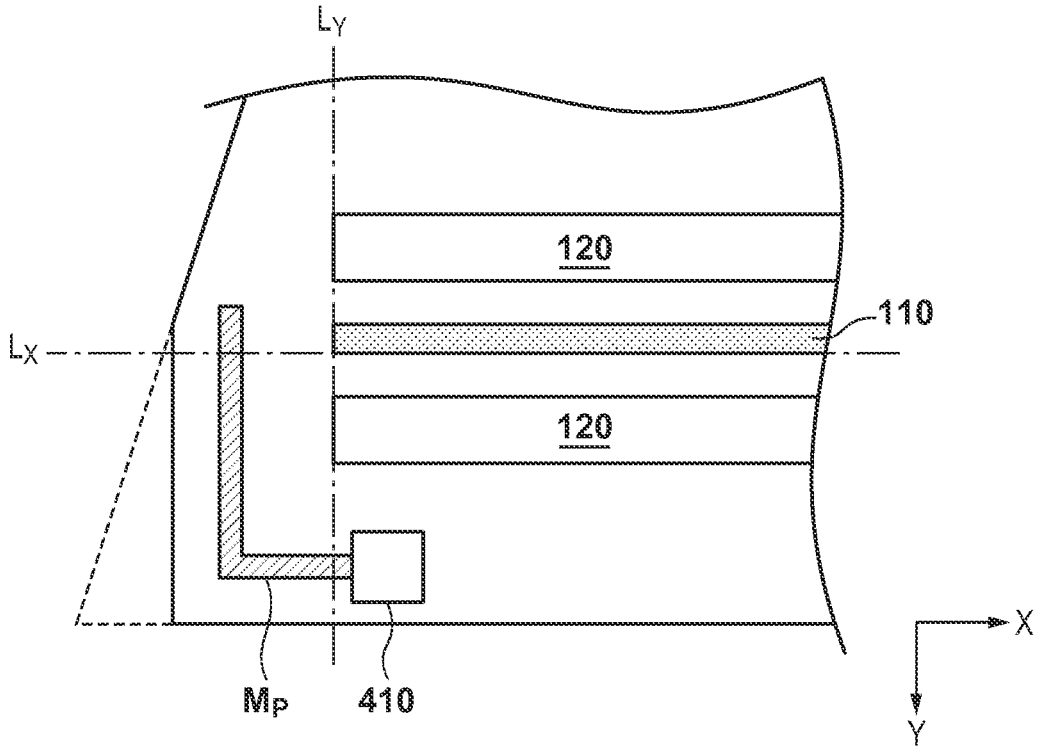
FIG. 14 is a view for explaining an example of the layout of a corner region of a printhead substrate.

Although a case in which the substrate $SUB_4$ of the printhead substrate $I_4$ has a shape of a parallelogram has been exemplified, the substrate SUB may have another shape, and may be partially processed in accordance with the purpose or the like. For example, as shown in FIG. 14, a substrate SUB may have a shape obtained by cutting part of a corner (a corner having an acute interior angle in this example) of a parallelogram along the Y direction. In this case, a metal pattern $M_D$ (the same as in the first embodiment) may be used as a metal pattern for detecting damage to a corner region RCa.

(Others)

Although several preferable embodiments have been exemplified, the present invention is not limited to them. The embodiments may be partially changed in accordance with the purpose or the like or respective features of the embodiments may be combined without departing from the spirit and scope of the present invention. That is, the arrangement of each unit can be changed in accordance with the purpose or the like. For example, the functions of two or more units may be implemented by one unit or part of the function of a given unit may be implemented by another unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-237018, filed Nov. 21, 2014 which is hereby incorporated by reference herein in its entirety.

What is claimed is:

1. A liquid discharging substrate comprising:

a plurality of discharging elements arrayed on the substrate;

a driving portion configured to drive the plurality of discharging elements;

a detecting portion including a metal pattern arranged via an insulating member on a corner region of the substrate, and configured to detect damage to the corner region when the metal pattern breaks; and a controlling portion which stops the driving portion in response to detection of damage to the corner region.

2. The liquid discharging substrate according to claim 1, wherein the metal pattern is formed in an L shape along an edge of the substrate in the corner region.

3. The liquid discharging substrate according to claim 1, wherein the corner region is a region surrounded by a first virtual line that passes through one end of each of the plurality of discharging elements arrayed on the substrate and is parallel to an array direction of the plurality of discharging elements, a second virtual line that passes through the one end and is parallel to a direction intersecting the array direction, and two sides that are connected to each other in the substrate and are closest to the one end.

4. The liquid discharging substrate according to claim 1, wherein the substrate has a rectangular shape in a planar view with respect to an upper surface of the substrate, and the metal pattern is arranged in each of four corner regions.

5. The liquid discharging substrate according to claim 1, wherein the substrate has a shape of a parallelogram in a planar view with respect to an upper surface of the substrate, and the metal pattern is arranged in each of at least two corner regions each having an acute interior angle out of four corner regions of the parallelogram.

6. The liquid discharging substrate according to claim 1, further comprising a signal line for transmitting a signal from the controlling portion to the driving portion so as to stop an operation of the plurality of discharging elements.

7. The liquid discharging substrate according to claim 1, wherein the detecting portion further includes:

a voltage supplying portion configured to supply a voltage to the metal pattern, and a determination portion configured to monitor the voltage of the metal pattern, and determine, based on a result of monitoring, whether the corner region has been damaged.

8. The liquid discharging substrate according to claim 7, wherein the liquid discharging substrate receives a first voltage as a ground voltage and a second voltage higher than the first voltage, the voltage supplying portion supplies the second voltage to the metal pattern, the metal pattern is connected, via a resistance element, to a node for transmitting the first voltage, and based on a potential difference between the second voltage and the voltage of the metal pattern as the result of monitoring, the determination portion determines whether the corner region has been damaged.

9. The liquid discharging substrate according to claim 7, wherein the liquid discharging substrate receives a first voltage as a ground voltage and a second voltage higher than the first voltage, the voltage supplying portion supplies the first voltage to the metal pattern, the metal pattern is connected, via a resistance element, to a node for transmitting the second voltage, and based on a potential difference between the first voltage and the voltage of the metal pattern as the result of monitoring, the determination portion determines whether the corner region has been damaged.

10. The liquid discharging substrate according to claim 7, wherein the metal pattern comprises a plurality of metal patterns sequentially arranged from an edge side of the substrate, the voltage supplying portion supplies a voltage to each of the plurality of metal patterns, and the determination portion monitors the voltage of each of the plurality of metal patterns, and determines a level of damage to the corner region based on results of monitoring.

11. The liquid discharging substrate according to claim 1, wherein the liquid discharging substrate comprises an inkjet printhead substrate, and the liquid discharging substrate further comprises a nozzle plate which is arranged on the metal pattern and in which a nozzle for discharging ink is formed.

12. The liquid discharging substrate according to claim 11 further comprising a plurality of metal layers arranged between the substrate and the nozzle plate, wherein the metal pattern is arranged in one of the plurality of metal layers closest to the nozzle plate.

13. The liquid discharging substrate according to claim 12, wherein a second metal pattern for performing one of an operation of transmitting signals from the plurality of discharging elements and an operation of supplying one of a signal and a voltage to each of the plurality of discharging elements is arranged in the one of the plurality of metal layers closest to the nozzle plate, the second metal pattern is covered with the nozzle plate via a protection film, and the metal pattern is covered with the nozzle plate without being via a protection film.

14. The liquid discharging substrate according to claim 11, wherein the metal pattern dissolves or corrodes due to ink.

15. A printhead comprising a printhead substrate, wherein the printhead substrate includes:

a plurality of discharging elements arrayed on the substrate, a driving portion configured to drive the plurality of discharging elements, a detecting portion including a metal pattern arranged via an insulating member on a corner region of the substrate, and configured to detect damage to the corner region when the metal pattern breaks, and a controlling portion which stops the driving portion in response to detection of damage to the corner region.

16. The printhead according to claim 15, wherein the printhead includes a plurality of printhead substrates, the printhead substrate being one of the plurality of printhead substrates, at least one of the plurality of printhead substrates includes a terminal configured to receive information indicating that the corner region of another printhead substrate has been damaged, and in the at least one printhead substrate, the controlling portion stops the driving portion based on the information received by the terminal.

17. The printhead according to claim 15, the printhead substrate further includes a signal line for transmitting a signal from the controlling portion to the driving portion so as to stop an operation of the plurality of discharging elements.

18. A printing apparatus comprising:

a printhead including a printhead substrate;

a scanning portion configured to cause the printhead to scan on a printing medium; and a conveying portion configured to convey the printing medium, wherein the printhead substrate includes:

a plurality of discharging elements arrayed on the substrate, a driving portion configured to drive the plurality of discharging elements, a detecting portion including a metal pattern arranged via an insulating member on a corner region of the substrate, and configured to detect damage to the corner region when the metal pattern breaks, and a controlling portion which stops the driving portion in response to detection of damage to the corner region.

19. The printing apparatus according to claim 18, the printhead substrate further includes a signal line for transmitting a signal from the controlling portion to the driving portion so as to stop an operation of the plurality of discharging elements.

20. A liquid discharging substrate comprising:

a plurality of discharging elements arrayed on the substrate;

a first region, which is surrounded by a first virtual line that passes through one end of the plurality of discharging elements and is parallel to an array direction of the plurality of discharging elements, a second virtual line that passes through the one end and intersects the array direction, and two sides of the substrate that are connected to each other and are closest to the one end;

a driving portion configured to drive the plurality of discharging elements;

a detecting portion including a metal pattern arranged via an insulating member on the first region of the substrate, and configured to detect damage to the first region when the metal pattern breaks, and a controlling portion which stops the driving portion in response to detection of damage to the first region.

21. The liquid discharging substrate according to claim 20, further comprising a signal line for transmitting a signal from the controlling portion to the driving portion so as to stop an operation of the plurality of discharging elements.

* * * * *